US008978327B2

(12) United States Patent
Guhl

(10) Patent No.: US 8,978,327 B2
(45) Date of Patent: Mar. 17, 2015

(54) FASTENING ARRANGEMENT FOR GLASS BALUSTRADES

(76) Inventor: Beat Guhl, Ottoberg (CH)

( * ) Notice: Subject to any disclaimer, the term of this patent is extended or adjusted under 35 U.S.C. 154(b) by 0 days.

(21) Appl. No.: 13/981,147

(22) PCT Filed: Oct. 21, 2011

(86) PCT No.: PCT/CH2011/000251

§ 371 (c)(1),
(2), (4) Date: Jul. 23, 2013

(87) PCT Pub. No.: WO2012/103656

PCT Pub. Date: Aug. 9, 2012

(65) Prior Publication Data

US 2013/0305639 A1 Nov. 21, 2013

(30) Foreign Application Priority Data

Jan. 31, 2011 (CH) ..... 163/11

(51) Int. Cl.
*E04B 1/38* (2006.01)
*E04B 2/72* (2006.01)
*E04F 11/18* (2006.01)

(52) U.S. Cl.
CPC ..... *E04B 2/721* (2013.01); *E04F 11/1851* (2013.01)
USPC ..... 52/285.1; 52/710; 52/716.8; 52/718.01

(58) Field of Classification Search
USPC ..... 52/27, 285.1, 698, 699, 708, 710, 52/716.8, 718.01
See application file for complete search history.

(56) References Cited

U.S. PATENT DOCUMENTS

| | | | | |
|---|---|---|---|---|
| 3,456,410 | A * | 7/1969 | Johnson et al. | 52/309.1 |
| 7,036,799 | B2 * | 5/2006 | Shepherd | 256/73 |
| 7,748,175 | B2 * | 7/2010 | Liebendorfer | 52/173.3 |
| 2008/0172978 | A1 * | 7/2008 | Caruso | 52/716.8 |
| 2011/0219722 | A1 | 9/2011 | Feigl | |

FOREIGN PATENT DOCUMENTS

| | | |
|---|---|---|
| DE | 10338816 | 5/2005 |
| DE | 202006009323 | 9/2006 |
| EP | 2112296 | 10/2009 |
| EP | 2365155 | 9/2011 |
| FR | 2930270 | 10/2009 |

* cited by examiner

*Primary Examiner* — Charles A Fox
*Assistant Examiner* — Patrick Maestri
(74) *Attorney, Agent, or Firm* — Volpe and Koenig, P.C.

(57) ABSTRACT

A fastening arrangement for glass balustrades for balconies, terraces and steps has a U-shaped receiving profile (1), between the two limbs (3, 5) of which a safety glass plate (39) is inserted. Dovetail grooves or T grooves (13) are embedded on the limbs (3, 5) of the receiving profile (1) and interact with corresponding dovetail grooves or T grooves on a fastening element (27). The fastening element (27) is first of all pushed into the grooves (13) on the receiving profile (1) and the fastening elements (27) are subsequently tightened at the destination. Any dimensional inaccuracy in the placing of the fastening elements (27) can be compensated for by moving the latter into other grooves in the receiving profile (1).

8 Claims, 3 Drawing Sheets

Fig. 7
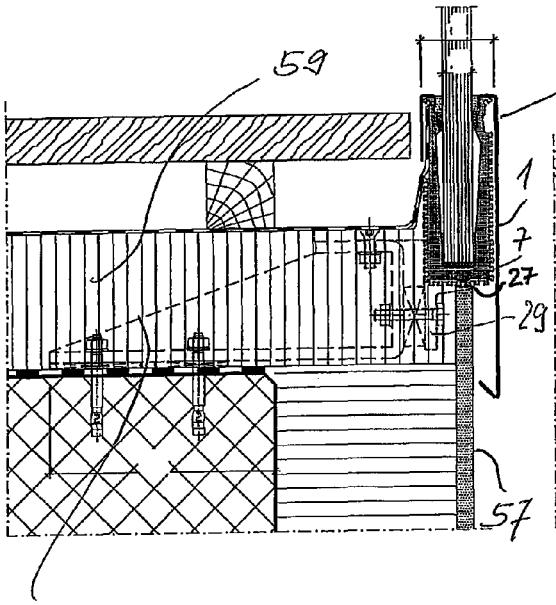
Fig. 8
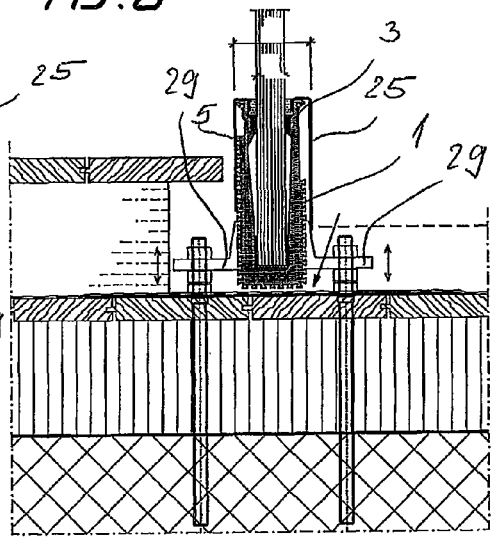
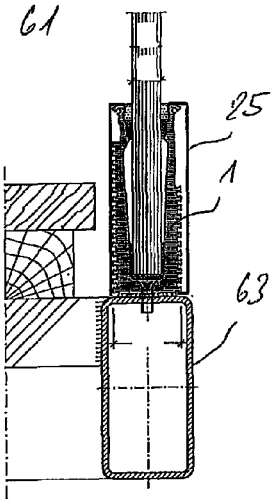
Fig. 9
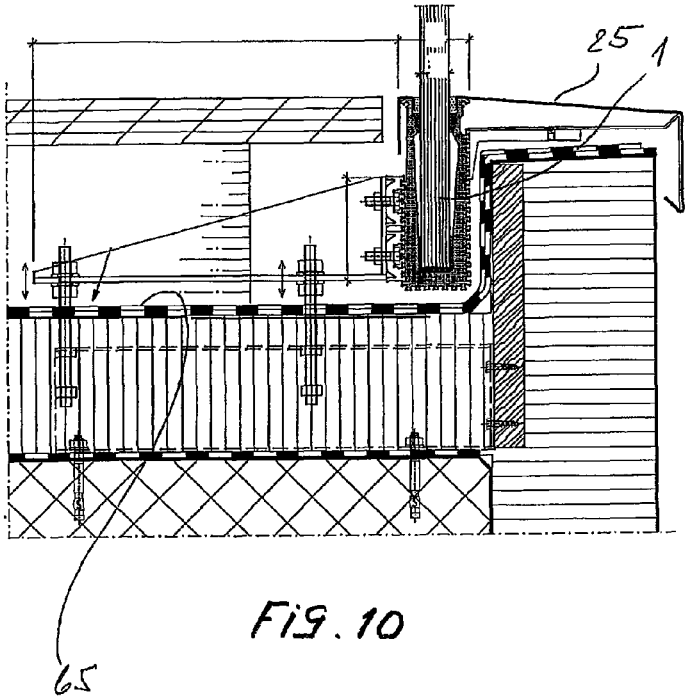
Fig. 10

FASTENING ARRANGEMENT FOR GLASS BALUSTRADES

BACKGROUND

The invention is directed to a fastening arrangement for glass balustrades.

For some years, balustrades at balconies, terraces, but also stairs are increasingly made from glass. Recently the glass plates used here are not held or inserted in metal frames but connected to the construction only in the area of their bottom edges. Here it is possible to provide the glass with bores and to fasten them with appropriate screws. However, far more frequently the lower section and/or the lower edge of the glass is inserted in a profile and connected thereto and subsequently the profile is fastened with suitable fastening means at the face, the top, or the bottom of the frontal edge of a balcony. Terrace balustrades and stair railings are usually fastened laterally. In order to optimally utilize the esthetics of frameless glass it is attempted to fasten the frame part, usually comprising metal, i.e. steel or aluminum, outside the visual range. Here, minute deviations during the assembly of the fastening elements can lead to the frame part receiving the glass not extending precisely parallel in reference to the surface of the balcony or the terrace. However, compensating unavoidable imprecisions in constructions is very expensive. Frequently, without any scaffolding new bores must be applied at the building in order to facilitate eliminating small, but esthetically unsatisfactory imprecisions.

SUMMARY

One objective of the present invention is to provide a fastening arrangement for glass balustrades for balconies, terraces, stairs, etc. which allows a simple, cost-effective assembly without setting very high demands to the precision during the assembly of the fastening elements at the construction site.

This objective is attained in a fastening arrangement according to the features the invention. Advantageous embodiments of the fastening arrangement are described below and in the claims.

By the presence of a plurality of grooves, extending parallel in reference to each other, preferably dovetail grooves or T-grooves, it is possible to fasten the glass balustrades in a precisely aligned fashion in the receiving profile for the glass plates as well as at the fastening elements to be connected to the receiving profile.

BRIEF DESCRIPTION OF THE DRAWINGS

The invention is explained in greater detail based on the illustrated exemplary embodiment. Shown are.

DETAILED DESCRIPTION OF THE PREFERRED EMBODIMENTS

Figure 1:
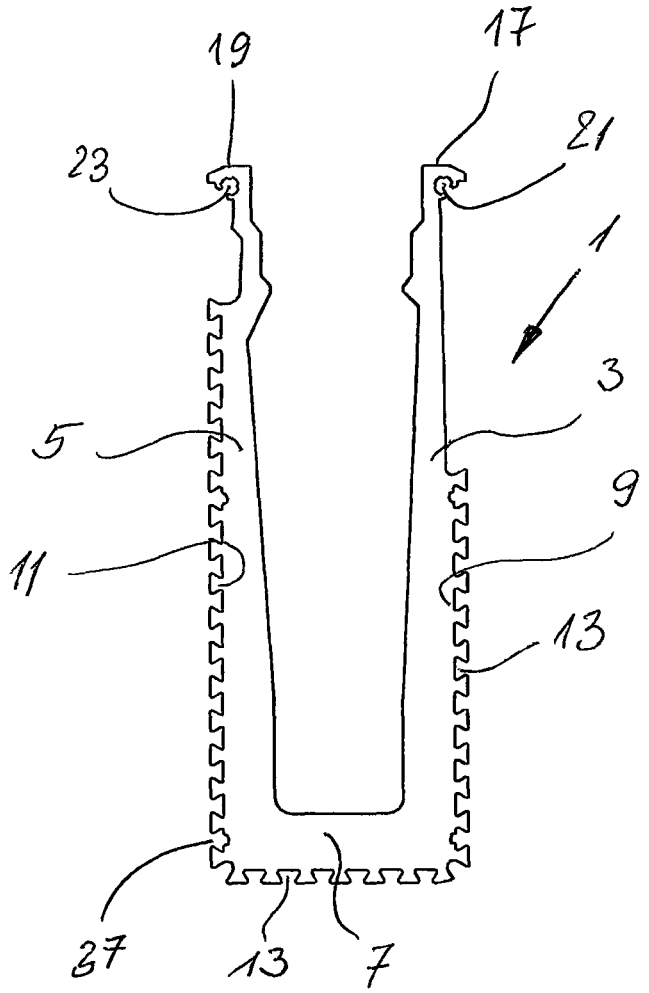
FIG. 1 a cross-section through the receiving profile.

The reference character 1 indicates a U-shaped receiving profile for a glass plate 2 for a balcony or terrace balustrade. The receiving profile 1 is preferably produced from aluminum and comprises an exterior leg 3 and an interior leg 5. At the bottom the two legs 3, 5 are connected to each other by a base plate 7. Grooves 13, extending parallel in reference to each other, particularly dovetail grooves or T-grooves are embedded in the exterior areas 9 and 11 of the two legs 3 and 5. These grooves extend at the interior leg 5 preferably approximately over its entire dimension. At the corners where the surfaces of the two legs 3, 5 and the base plate 7 meet, a corner groove 15 may be embedded at an angle of 45°, which extends parallel in reference to the other grooves 13.

The upper end and/or the upper edges 17, 19 of the two legs 3, 5 are bent towards the outside and comprise a fastening groove 21, in which after the fastening a cover plate or a blind 25 can be suspended. Preferably the interior areas of the legs 3, 5 are embodied aligned v-shaped in reference to each other.

Figure 2:
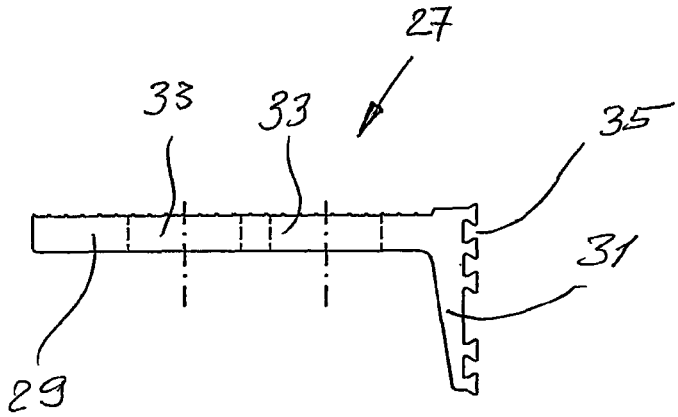
FIG. 2 a cross-section through an L-shaped fastening element.

A possible embodiment of a fastening element for the receiving profile 1, also called angle bracket 27, is shown in FIG. 2. This is once more preferably made from aluminum in the extrusion method. The L-shaped fastening element 27 comprises a fastening leg 29 and a connection leg 31. The fastening leg 29 comprises at least one hole or one bore 33 for a fastening screw 33 penetrating it, by which the fastening element 27 can be fastened at a building (balcony floor, terrace floor, or generally a building wall 41). Further, dovetail grooves or T-grooves 35 are formed at the exterior area of the connection legs 31, which are consistent and/or sized such in reference to the dovetail grooves or T-grooves at the legs 3, 5 and those at the base plate 7 of the receiving profile that every fastening element 27 can be inserted at an arbitrary position into the grooves 13. In order to fasten and secure the fastening element 27 using the fastening elements 27 and/or a threaded bore inserted therein a stud screw can be screwed into the receiving profile (stud screw not shown) in a groove 13 or a screw channel 37 provided for this purpose.

Figure 3:
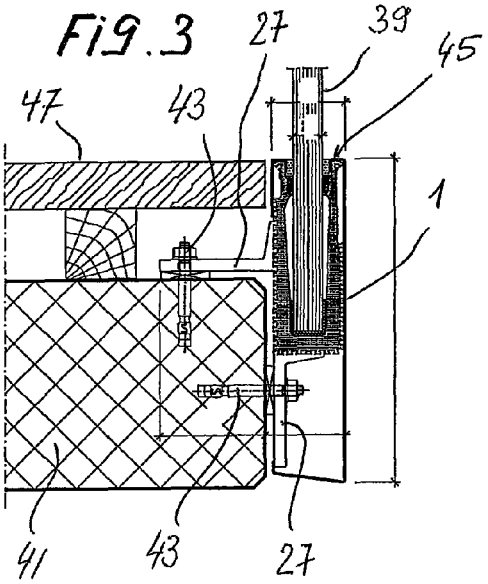
FIG. 3 a fastening arrangement at a balcony slab (facial assembly)

In the following some fastening examples are explained in greater detail. In FIG. 3 the receiving profile 1 is shown fastened with two fastening elements 27 and two screws 43 at the face of the balcony slab 41. Before the fastening of the fastening element 27 can occur at the balcony slab 41 the fastening elements 27 are laterally inserted at the receiving profiles 1 and at the predetermined positioned, i.e. at a predetermined distance side-by-side and fixed here by stud screws. Due to the fact that the receiving profile 1 is made from aluminum and is very light it can simply be placed upon the balcony slab and screw holes to be drilled for the screws 43 can be inserted. When the receiving profile 1 is preliminarily fastened it can therefore be checked if its upper edge 45 is actually parallel in reference to the surface 47 of the balcony slab 41. If this is the case, the screws 43 can be tightened. However, if that is not the case the fastening elements 27 can be displaced by one, two, or more grooves, once more fastened at the receiving profile 1. Of course, depending on the embodiment of the balcony slab 41, the position of the receiving profile 1 can be connected at a higher or lower point with the fastening elements 27. After the definite fastening of the receiving profile 1 a safety glass 39 can be inserted from the top between the two legs 3, 5. In order to ensure an optimal fastening even with regards to unexpected horizontal forces upon the safety glass the lower edge of the safety glass is coated with an elastic material. Slightly below the upper edge 45 of the receiving profile 1, between the two glass surfaces and the two interior areas of the legs 3, 5, an elastic element is inserted, such as rubber or an elastic sealing material. After the assembly of the safety glass 19 this (material) can be protected from the top with a liquid sealing material against the penetration of rain water and dirt.

Figure 4:
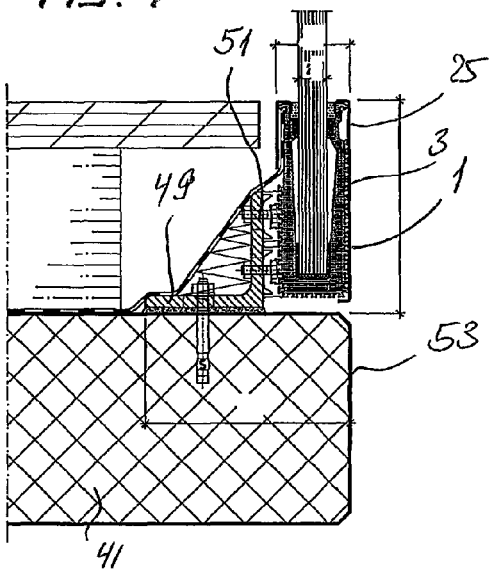
FIG. 4 a fastening arrangement at a balcony slab (fastening at the top)

In the exemplary embodiment according to FIG. 4, the frame profile 1 is fastened with a fastening angle 49 at its one leg via adjustment screws 51 provided with grooves, which engage the grooves 13 at the receiving profile 1. The facial edge 53 of the balcony slab 41 is now located in one plane with the exterior leg 3 of the receiving profile 1.

Figure 5:
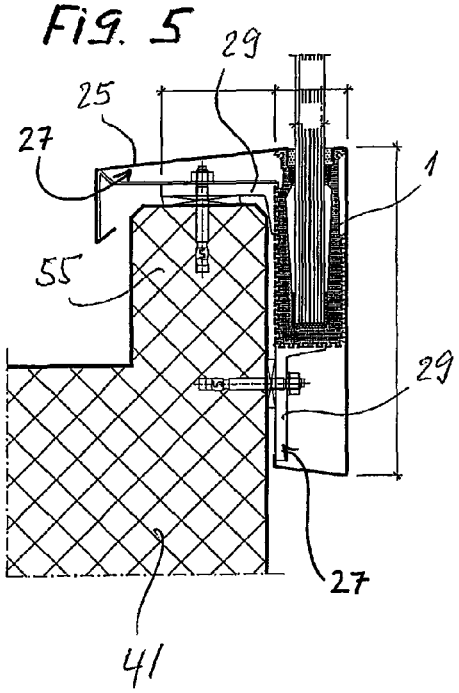
FIG. 5 a fastening arrangement at a balcony slab (fastening at a peripheral edge), FIG. 6 a fastening arrangement at a balcony slab (fastening at the peripheral edge, however at the inside), FIG. 7 a fastening arrangement at a terrace edge (exterior), FIG. 8 a fastening arrangement at a terrace edge (a fastening on the top of the floor), FIG. 9 a fastening arrangement at a terrace edge (fastening on an auxiliary profile at a building made from wood), and FIG. 10 a fastening arrangement at a terrace edge (fastening at the inside of a peripheral wall element).

In FIG. 5, a receiving profile 1 is fastened with two fastening elements 27 at a circumferential edge 55 outside the balcony slab 41. One fastening element 27 engages the base plate 7, the other one in the upper section of the interior leg 5.

Figure 6:
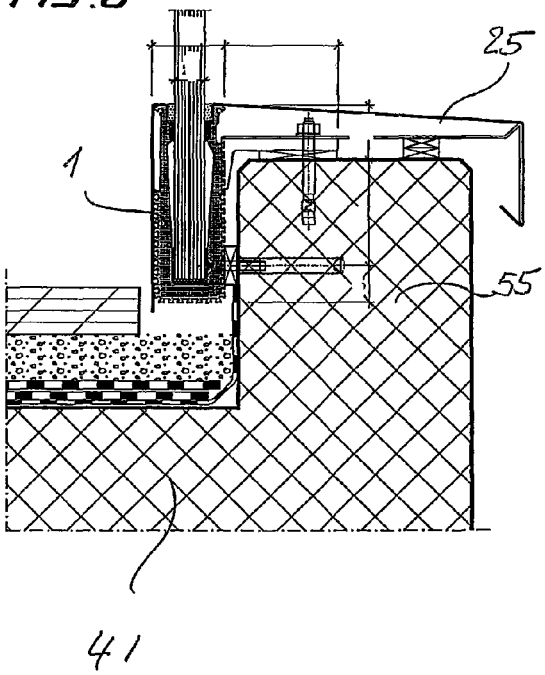

In FIG. 6, the receiving profile 1 is located inside the circumferential edge 55 at the balcony slab 41.

In the embodiment of the fastening according to FIG. 7, the receiving profile 1 is connected at its base plate 7 with a fastening element 27. This allows for the receiving profile 1 to slightly project beyond the exterior face of a façade 57. The fastening element 27 is here fastened at a console 61 inserted in an insulating plate 59.

In the embodiment of the fastening of the receiving profile 1 according to FIG. 8, the latter is fastened with two fastening elements 27, each of which engaging at the inner leg 5 and at the outer leg 3, on the surface of a plate, e.g., a walkable roof.

In the embodiment of the invention according to FIG. 9, the receiving profile 1 rests on a square pipe 63 which is welded with its face to a metal structure.

In the embodiment of the invention according to FIG. 10, which is essentially equivalent to the design according to FIG. 7, it is shown how the receiving profile 1 can be place over a flat roof—sealing film 65.

The invention claimed is:

1. A fastening arrangement for glass balustrades for balconies (41), terraces, or stairs, comprising a receiving profile (1) for receiving and fastening at a bottom of a safety glass plate (39), on each of three exterior areas (9, 11, 7) of the receiving profile (1) several dovetail grooves or T-grooves (13) are embedded, in which at an arbitrary position both along a longitudinal extension of the profile (1) as well as laterally in reference thereto, fastening elements (27) having complementary dovetails or T-shapes are applied and fastened, with two of the fastening elements being connected spaced apart from one another at each fastening location along the longitudinal length of the profile.

2. A fastening arrangement according to claim 1, wherein the receiving profile (1) has a U-shaped profile, with the exterior areas (9, 11) of two legs (3, 5) pointing upwards being parallel in reference to each other and interior areas of the two legs (3, 5) extending in a V-shaped fashion.

3. A fastening arrangement according to claim 2, wherein at least one of the exterior areas (9, 11) of the legs (3, 5) or the base plate (7), connecting the legs (3, 5) at said bottom, includes a plurality of grooves (13) extending parallel to each other.

4. A fastening arrangement according to claim 3, wherein open grooves are located at a transition between the exterior areas (9, 11) of the legs (3, 5) and the base plate (7), which allows an insertion of the fastening element (27) which partially also projects beyond a surface of the profiles.

5. A fastening arrangement according to claim 1, wherein one or more grooves (13) are embodied with an enlarged open area extending into the receiving profile in comparison to other ones of the grooves to form screw channels (37).

6. A fastening arrangement according to claim 1, wherein the fastening elements (27) are embodied L-shaped or T-shaped, and sections are embedded with counter grooves (35) embodied complementary to the grooves (13), which are inserted into the grooves (13) at the profiles (1) at a suitable position.

7. A fastening arrangement according to claim 2, wherein a section of an upper edge of the legs (3, 5) has ribs or projections formed at an interior side thereof, with seals or an adhesive or sealing material inserted thereabove.

8. A fastening arrangement according to claim 2, wherein at upper edges (17, 19) of the legs (3, 5), sections are embodied projecting outwardly in which blinds (25) are latched.

* * * * *